US011713593B2

(12) United States Patent
Lai

(10) Patent No.: US 11,713,593 B2
(45) Date of Patent: Aug. 1, 2023

(54) HOOK LOCK WITH DUAL LOCKING FUNCTION WITH KEY CAPTIVE DESIGN

(71) Applicant: The Sun Lock Company Limited, Tuen Mun (HK)

(72) Inventor: Karl Lai, Tai Po (HK)

(73) Assignee: THE SUN LOCK COMPANY LIMITED, Hong Kong (HK)

( * ) Notice: Subject to any disclaimer, the term of this patent is extended or adjusted under 35 U.S.C. 154(b) by 425 days.

(21) Appl. No.: 17/098,964

(22) Filed: Nov. 16, 2020

(65) Prior Publication Data

US 2021/0189766 A1 Jun. 24, 2021

Related U.S. Application Data

(60) Provisional application No. 62/949,543, filed on Dec. 18, 2019.

(51) Int. Cl.
*E05B 37/00* (2006.01)
*E05B 37/02* (2006.01)
*E05B 35/10* (2006.01)

(52) U.S. Cl.
CPC ..... *E05B 37/0034* (2013.01); *E05B 35/105* (2013.01); *E05B 37/025* (2013.01)

(58) Field of Classification Search
CPC ..... E05B 37/00; E05B 37/06; E05B 37/0034; E05B 37/025; E05B 35/205; Y10T 70/413; Y10T 70/415; Y10T 70/7141; Y10T 70/7147; Y10T 70/7305
USPC ..... 70/21, 24–30, 284, 285, 312
See application file for complete search history.

(56) References Cited

U.S. PATENT DOCUMENTS 5,175,709 A 12/1992 Slayton et al.
5,901,587 A * 5/1999 Chen ..... E05B 37/025 70/312
6,029,481 A 2/2000 Lai
6,035,672 A 3/2000 Lai
(Continued)

FOREIGN PATENT DOCUMENTS

CN 206468121 U 9/2017
EP 1529907 B1 12/2012
(Continued)

OTHER PUBLICATIONS

Combined Search and Examination Report for Application No. GB2018305.9; dated May 20, 2021 (7 pages).

*Primary Examiner* — Suzanne L Barrett
(74) *Attorney, Agent, or Firm* — Ware, Fressola, Maguire & Barber LLP

(57) ABSTRACT

The lock has a hook, a locking finger and a latch. The locking finger is engaged with the hook and the latch when the lock is in the locked mode. The locking finger is disengaged from the hook and the latch when the lock is in the opened mode. The lock can be opened by a combination mechanism or by an overriding key mechanism. The combination mechanism has a button, and a plurality of dials and clutches to control the movement of the button. When the dials are set to a correct combination, the button can be moved to disengage the latch from the locking finger, allowing the locking finger to disengage from the hook. The key mechanism has a cylinder with a key slot to receive a key for rotating the cylinder to disengage the latch from the locking finger, allowing the locking finger to disengage from the hook.

13 Claims, 6 Drawing Sheets

(56) References Cited

U.S. PATENT DOCUMENTS

| | | | |
|---|---|---|---|
| 6,164,096 | A | 12/2000 | Lai |
| D439,824 | S | 4/2001 | Lai |
| D439,825 | S | 4/2001 | Lai |
| 6,408,660 | B1 | 6/2002 | Lai |
| 6,474,116 | B1 | 11/2002 | Lai |
| D472,790 | S | 4/2003 | Lai |
| 6,675,614 | B2 | 1/2004 | Lai |
| 6,729,166 | B1 | 5/2004 | Lai |
| 6,742,366 | B1 | 6/2004 | Lai |
| D498,132 | S | 11/2004 | Lai |
| 6,883,355 | B2 | 4/2005 | Lai |
| D511,673 | S | 11/2005 | Lai |
| 7,114,356 | B1 | 10/2006 | Yu |
| 7,117,698 | B2 | 10/2006 | Lai |
| 7,140,209 | B2 | 11/2006 | Lai |
| 7,225,648 | B2 | 6/2007 | Lai |
| 7,467,531 | B2 | 12/2008 | Lai et al. |
| 7,562,545 | B2 | 7/2009 | Lai et al. |
| 7,628,045 | B2 | 12/2009 | Yu |
| 7,685,851 | B2 | 3/2010 | Lai |
| 7,698,913 | B2 | 4/2010 | Lee |
| 7,765,840 | B2 | 8/2010 | Lai et al. |
| 8,056,376 | B2 | 11/2011 | Yu |
| 8,096,150 | B2 | 1/2012 | Lai et al. |
| 8,261,583 | B2 | 9/2012 | Lai et al. |
| 8,511,118 | B2 | 8/2013 | Lai et al. |
| 8,661,861 | B2 | 3/2014 | Lai |
| 8,776,556 | B2 | 7/2014 | Lai |
| 8,826,703 | B2 | 9/2014 | Lai |
| 8,919,155 | B2 | 12/2014 | Lai |
| 8,931,313 | B2 | 1/2015 | Lai |
| 9,206,625 | B2 | 12/2015 | Lai |
| 9,228,373 | B2 | 1/2016 | Huang |
| 9,228,376 | B2 | 1/2016 | Lai |
| 9,441,399 | B2 | 9/2016 | Yu |
| 9,464,460 | B2 | 10/2016 | Lai |
| 9,487,969 | B2 | 11/2016 | Lai |
| 9,556,650 | B1 | 1/2017 | Lai |
| 9,663,970 | B1 | 5/2017 | Yang |
| D789,174 | S | 6/2017 | Lai |
| 9,803,398 | B2 | 10/2017 | Lai |
| 9,890,559 | B2 | 2/2018 | Lai |
| 10,047,541 | B2 | 8/2018 | Lai |
| 10,214,942 | B2 | 2/2019 | Lai |
| 10,221,591 | B2 | 3/2019 | Lai |
| D864,695 | S | 10/2019 | Lai |
| 10,443,272 | B2 | 10/2019 | Lai |
| D902,691 | S | 11/2020 | Lai |
| 10,890,013 | B2 | 1/2021 | Lai |
| D914,481 | S | 3/2021 | Lai |
| 11,199,025 | B2 | 12/2021 | Lai |
| 11,261,622 | B2 | 3/2022 | Lai |
| 11,346,127 | B2 | 5/2022 | Lai |
| 2006/0123857 | A1* | 6/2006 | Ling ..... E05B 37/0034 70/21 |
| 2008/0083251 | A1 | 4/2008 | Lai et al. |
| 2008/0307834 | A1 | 12/2008 | Ma |
| 2009/0031764 | A1 | 2/2009 | Huang |
| 2014/0338407 | A1 | 11/2014 | Zhang |
| 2021/0189766 | A1 | 6/2021 | Lai |
| 2022/0065001 | A1 | 3/2022 | Lai |

FOREIGN PATENT DOCUMENTS

| | | | | |
|---|---|---|---|---|
| GB | 2577281 | B | 9/2020 | |
| GB | 2586332 | A | 2/2021 | |
| GB | 2591571 | A * | 8/2021 | ..... E05B 15/00 |

* cited by examiner

HOOK LOCK WITH DUAL LOCKING FUNCTION WITH KEY CAPTIVE DESIGN

CROSS REFERENCE TO RELATED APPLICATION

This application claims the benefit of U.S. Provisional Application No. 62/949,543, filed Dec. 18, 2019, which is incorporated by reference herein in its entirety.

TECHNICAL FIELD

The present invention relates to locks, in particular a hook lock that can be unlocked by a combination mechanism or by an overriding key mechanism.

BACKGROUND OF THE INVENTION

The present invention is a hook lock with a dual locking function enclosed in a lock body/housing. The hook lock can be opened by a combination mechanism or by an overriding key mechanism. The key mechanism to override the combination mechanism, like that in many Transportation Security Administration (TSA)-compliant luggage locks, allows a TSA agent to open the lock with a key.

SUMMARY OF THE DISCLOSURE

The hook lock has a hook and a locking finger. The locking finger is engaged with the hook when the lock is operated in the locked mode. The locking finger is disengaged from the hook when the lock is operated in the opened mode. The hook lock can be opened by a combination mechanism or by an overriding key mechanism. The combination mechanism has a plurality of dials with indicia to form a correct combination to open the lock. The key mechanism has a cylinder with a key slot to receive a correct key. The cylinder must be rotated to open the lock. After the lock is opened with a key, the cylinder cannot be rotated back to its initial position before the locking finger is pushed back to engage with the hook. This key-captive feature ensures that the lock will be put back to the locked position after the key-user opens the lock.

Thus, it is an aspect of the present invention to provide a hook lock, operable in a locked mode and in an opened mode, said lock comprising:

a lock body having a first body portion and a second body portion;

a hook located in the first body portion;

a locking finger pivotally mounted in the first body portion in relationship to the hook, the locking finger operable in a first finger position when the lock is in the locked mode, and in a second finger position when the lock is in the opened mode;

a combination mechanism located in the second body portion;

a latch operable in a first latch position and a second latch position, wherein when the latch is in the first latch position, the locking finger is prevented from moving from the first finger position to the second finger position, and when the latch is in the second latch position, the locking finger is allowed to move from the first finger position to the second finger position;

a button located in the first body portion in relationship to the combination mechanism, the button operable in a first button position and a second button position, wherein when the button is caused to move from the first button position to the second button position, the latch is caused to move from the first latch position to the second latch position.

In an embodiment of the present invention, the latch comprises a latch tip and the locking finger comprises a cutout dimensioned to receive the latch tip when the latch is in the first latch position, and when the latch is caused to move from the first latch position to the second latch position, the latch tip is disengaged from the cutout, allowing the locking finger to move from the first finger position to the second finger position.

In an embodiment of the present invention, the combination mechanism comprises a spindle having a longitudinal axis, the spindle comprising a first spindle end and a second spindle end, the first spindle end having a contact surface positioned in relationship to the button, and when the combination mechanism is set to a correct combination, the spindle can be caused to move from a first spindle position to a second spindle position in a spindle movement direction substantially parallel to the longitudinal axis, and wherein when the combination mechanism is set to the correct combination and the button is moved from the first button position to the second button position, the contact surface is caused to move along with the spindle from the first spindle position to the second spindle position in the spindle movement direction, and the latch is caused to move in a latch movement direction from the first latch position to the second latch position, wherein the latch movement direction is substantially parallel to the spindle movement direction.

In an embodiment of the present invention, the combination mechanism further comprises:

a plurality of clutches disposed around the spindle, and a plurality of dials engageable with the clutches to control movement of the spindle, the dials having a plurality of indicia to form the correct combination, and wherein the button comprises a button slope positioned in relationship to the contact surface of the spindle and wherein when the button is moved from the first button position to the second button position, the button slope of the button causes the contact surface to move along with the spindle from the first spindle position to the second spindle position in the spindle movement direction.

In an embodiment of the present invention, the latch further comprises a latch slope and the button is associated with an extended edge having an edge slope positioned in relationship to the latch slope, and wherein when the button is moved from the first button position to the second button position, the edge slope of the extended edge is arranged to cause the latch slope together with the latch to move in the latch movement direction.

In an embodiment of the present invention, the lock further comprises:

an overriding key mechanism comprising a cylinder positioned in relationship to the button, the cylinder comprising a first cylinder end and a second cylinder end, wherein the extended edge is fixedly mounted on the second cylinder end, and wherein when the button is moved from the first button position to the second button position, the edge slope of the extended edge and the cylinder is caused to move together with the button.

In an embodiment of the present invention, the first cylinder end comprises a key slot dimensioned to receive a key and wherein when the button is in the first button position and the key is inserted into the key slot of the cylinder, the cylinder can be caused to rotate from a first cylinder position to a second cylinder position together with the extended edge in a rotation direction relative to the button, the edge slope is arranged to move the latch slope together with the latch in a latch movement direction from the first latch position to the second latch position.

In an embodiment of the present invention, the locking finger further comprises a restriction wall and the cylinder further comprises a key-captive slot dimensioned to receive the restriction wall of the locking finger, and wherein when the cylinder is in the second cylinder position and the locking finger is in the second finger position, the restriction wall of the locking finger is engaged with the key-captive slot, preventing the cylinder from moving from the second cylinder position to the first cylinder position, and when the cylinder is in the second cylinder position, the key is prevented from moving out of the key slot.

In an embodiment of the present invention, when the cylinder is in the second cylinder position, the locking finger can be caused to return to the first finger position and the restriction wall of the locking finger is disengaged from the key-captive slot of the cylinder, allowing the cylinder to return to the first cylinder position and the key to be retrieved from the key slot.

In an embodiment of the present invention, the lock body further comprises a torque spring positioned in relationship to the locking finger, and when the latch tip is disengaged from the cutout of the locking finger, the torque spring is arranged to urge the locking finger to move from the first finger position to the second finger position.

In an embodiment of the present invention, the spindle further comprises a plurality of protrusions and each of the clutches comprises an opening gap associated with the protrusion of a different one of the spindle, and wherein when the dials are set at the correct combination, the opening-gap of each of the clutches is aligned to the associated protrusion of the spindle, allowing the spindle to move from the first spindle position to the second spindle position.

In an embodiment of the present invention, the lock body further comprises a spring positioned in relationship to the spindle, and when the button is located in the first button position, the spring is arranged to urge the spindle to remain in the first spindle position.

In an embodiment of the present invention, the spindle also has a top edge associated with the contact surface, and the plurality of clutches form a stack of clutches disposed around the spindle, wherein the spring is placed between the top edge of the spindle and the stack of clutches.

In an embodiment of the present invention, the lock body further comprises a spring positioned in relationship to the latch, the spring is arranged to urge the latch to move toward the locking finger.

In an embodiment of the present invention, wherein each of the clutches is associated with a different one of the dials, each of the clutches comprising a plurality of clutch fins, each of the dials comprising a plurality of teeth arranged to engage with the clutch fins for rotation together relative to the spindle, and wherein when the spindle is in the second spindle position, the clutches can be caused to move relative to the spindle and the dials to a reset position so that the clutch fins become disengaged from the teeth while the protrusions of the spindle are engaged with the opening gaps of the clutches, allowing the dials to rotate relative to the clutches, and wherein the clutch fins comprises one or more longer fins, and the lock body further comprises a plurality of notches arranged to receive the long fins when the clutches are in the reset position, preventing the clutches from rotation relative to the spindle.

In an embodiment of the present invention, the lock further comprises a key mechanism comprising a cylinder, the cylinder having a first cylinder end and a second cylinder end, and an extended edge fixedly mounted on the second cylinder end, wherein the first cylinder end comprises a key slot dimensioned to receive a key, and when the key is inserted into the key slot of the cylinder, the cylinder can be caused to rotate from a first cylinder position to a second cylinder position together with the extended edge in a rotation direction relative to the button, and the edge slope is arranged to move the latch slope together with the latch from the first latch position to the second latch position, wherein the locking finger further comprises a restriction wall and the cylinder further comprises a key-captive slot dimensioned to receive the restriction wall of the locking finger, and wherein when the cylinder is in the second cylinder position and the locking finger is in the second finger position, the restriction wall of the locking finger is engaged with the key-captive slot, preventing the cylinder from moving from the second cylinder position to the first cylinder position, and when the cylinder is in the second cylinder position, the key is prevented from moving out of the key slot.

In an embodiment of the present invention, the lock comprises a lock body;

a hook fixedly disposed on the lock body;

a locking finger pivotal mounted on the lock body in relationship to the hook, the locking finger operable in a first finger position when the lock is in the locked mode, and in a second finger position when the lock is in the opened mode;

a latch operable in a first latch position and a second latch position, wherein when the latch is in the first latch position, the locking finger is prevented from moving from the first finger position to the second finger position, and when the latch is in the second latch position, the locking finger is allowed to move from the first finger position to the second finger position, wherein the latch comprises a latch tip and the locking finger comprises a cutout dimensioned to receive the latch tip when the latch is in the first latch position, and when the latch is caused to move from the first latch position to the second latch position, the latch tip is disengaged from the cutout, allowing the locking finger to move from the first finger position to the second finger position; a key mechanism comprising a cylinder, the cylinder having a first cylinder end and a second cylinder end, and an extended edge fixedly mounted on the second cylinder end, wherein the first cylinder end comprises a key slot dimensioned to receive a key and when the key is inserted into the key slot of the cylinder, the cylinder can be caused to rotate from a first cylinder position to a second cylinder position together with the extended edge in a rotation direction relative to the lock body, and the edge slope is arranged to move the latch slope together with the latch from the first latch position to the second latch position, wherein the locking finger further comprises a restriction wall and the cylinder further comprises a key-captive slot dimensioned to receive the restriction wall of the locking finger, and wherein when the cylinder is in the second cylinder position and the locking finger is in the second finger position, the restriction wall of the locking finger is engaged with the key-captive slot, preventing the cylinder from moving from the second cylinder position to the first cylinder position, and when the cylinder is in the second cylinder position, the key is prevented from moving out of the key slot.

The present invention will become apparent upon reading the description in conjunction with FIGS. 1A-14B.

DETAILED DESCRIPTION OF THE INVENTION

The numbering of the lock and its components is as follows:

Padlock. 20 Lock Body. 20*a* Tail-receiving slot. 21 Hook. 22 cylinder-receiving hole. 23 Pivot-pole. 24 torque-spring slot. 25 Stopping edge. 26 Latch path. 27 Cut Edge. 28 Notch. 29 Spindle wall. 30 Lock Body other half. 30*a* Tail-receiving slot. 31 cylinder-receiving hole. 32 Pole-receiving hole. 33 Stopping edge. 34 Body Wall. 35 Cut Edge. 36 Latch path. 37 Notch. 40 Locking Finger. 41 Locking Tip. 42 Restriction wall. 43 torque-spring wall. 44 pole-receiving hole. 45 Cutout. 46 Locking-finger Tail. 50 Button. 51 Button edge. 52 Button Wall. 53 Button Slope. 54 Rotational-control slot. 55 Wafer Slot. 60 Cylinder. 61 Control Edge. 62 Edge Slope. 63. Extended edge. 64 Key-Captive Slot. 68 Key slot. 70 Spindle. 71 Contact surface. 72 Top Edge. 73 Protrusion. 78. Longitudinal Axis. 80 Clutch. 81. Short Fin. 82 Long Fin. 83 Opening Gap. 84 Clutch Opening. 85 Faulty gates. 90 Dial. 91 Teeth. 100 Reset-Button Clutch. 101 Short Fin. 102 Long Fin. 103 Opening Gap. 104 Button knob. 105 Clutch Opening. 106 Faulty gates. 110 Torque Spring. 120 Spindle Spring. 130 Separation Ring. 140 Key. 150 Latch. 151 Latch Tip. 152 Latch Slope. 153 Latch Surface. 154 Spring hole. 160 Latch Spring.

Components that are mentioned in the specification but not numbered: Wafers and wafer springs in the cylinder and the ratchet spring plate associated with the dials.

Locked Mode (FIG. 1A-11)

Figure 1A:
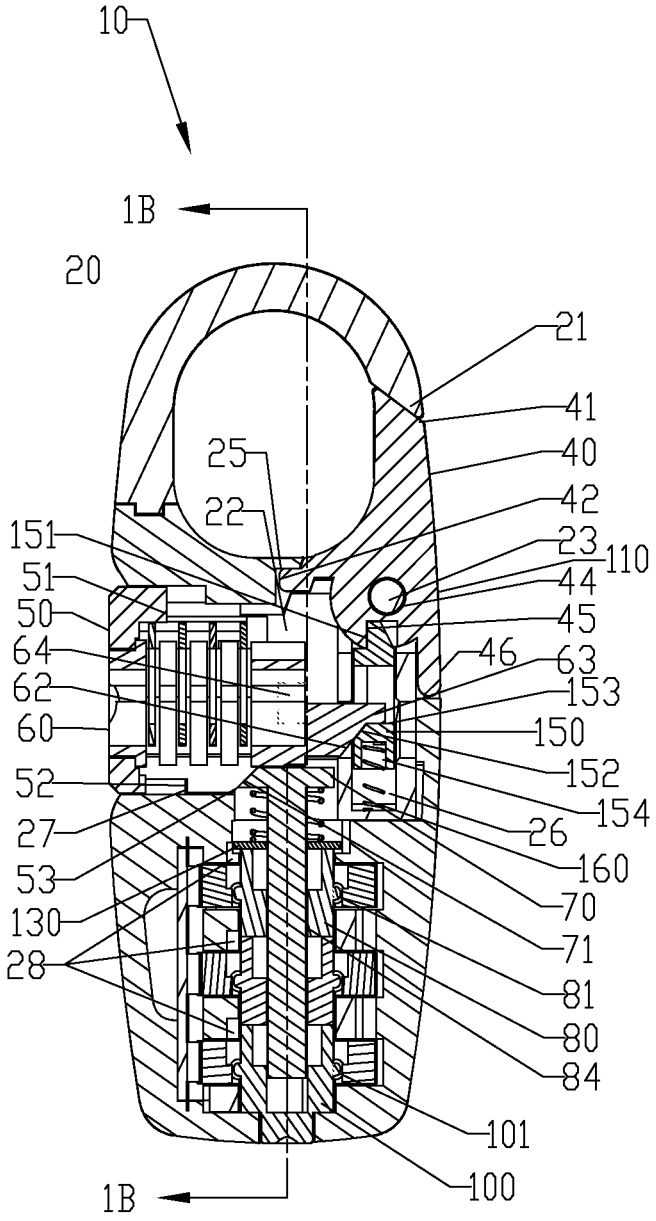
FIG. 1A is a cross-sectional view of the hook lock according to an embodiment of the present invention taken along line 1A-1A of FIG. 1B.

A padlock 10, according to an embodiment of the present invention, has a lock body 20 (20/30) with a built-in hook 21 as a member to hook up an object to be locked. A locking finger 40 is engaged with the hook 21 when the lock 10 is operated in the locked mode and is disengaged with the hook 21 when the lock 10 is operated in the opened mode. The locking finger 40 has a locking tip 41 arranged to contact the tip of the hook 21 when the locking finger 40 is engaged with the hook 21. The movement of locking finger 40 is facilitated by a torque spring 110 which is hinged on a torque-spring slot 24 of lock body 20 and a torque-spring wall 43 of locking finger 40. As illustrated in FIG. 1A, the torque spring 10 is obscured by the locking finger 40. When the lock 10 is in the opened mode, a user must manually move the locking finger 40 back to its engaging position with the hook 21. The user may push the locking-finger tail 46 of the locking finger 40 back into a tail-receiving slot 20*a*/30*a* of lock body 20/30 so as to engage the locking tip 41 with the hook 21. The locking finger 40 is pivotally mounted on lock body 20. The locking finger 40 has a pole-receiving hole 44 which is located between a pivot pole 23 and a pole-receiving hole 32 of lock body 20/30. The locking finger 40 also has a torque-spring wall 43 for mounting the torque spring 110. One end of torque spring 110 is placed in a torque-spring slot 24 of lock body 20, and the other end of torque spring 110 is placed in the torque-spring wall 43 of locking finger 40. The lock body 20/30 has a stopping edge 25/33, and the locking finger 40 has a restriction wall 42 arranged to contact the stopping edge 25/33 once the locking finger 40 is moved back to its engaging position from the disengaging position. The restriction wall 42 and the stopping edge 25/33 prevent the locking finger 40 from pivoting further from the engaging position to ensure that the locking tip 41 stays in a locked position with the hook 21.

The Overriding Key Mechanism

The overriding key mechanism has a cylinder 60 partially assembled inside a button 50. The body 20/30 has a cylinder-receiving hole 22/31 dimensioned to receive the cylinder 60. As the button 50 is arranged as a cylinder housing, the button 50 is also installed in part of the cylinder-receiving hole 22/31. The cylinder 60 has a control edge 61. The button 50 has a rotation-control slot 54 dimensioned to receive the control edge 61 of cylinder 60. In the locked mode, wafers (not shown) in the cylinder 60 are pushed outward by wafer springs (not shown) into the wafer slots 55, preventing the cylinder 60 from a rotational movement. The button 50 has a button wall 52 arranged to contact a cut edge 27/35 of lock body 20/30. The button wall 52 prevents the button 50 from having a rotational movement relative to lock body 20. The button wall 52 also limits the button 50 from traveling beyond the cut-edge 27/35 so as to prevent the button 50 from falling out of the cylinder-receiving hole 22/31.

The lock 10 has a latch 150 to control the pivotal movement of the locking finger 40. The latch 150 has a latch slope 152 and a latch surface 153. The cylinder 60 has an edge slope 62 and an extended edge 63 positioned in relationship to the latch slope 152 and the latch surface 153. When the lock 10 is operated in the locked mode, the cylinder 60 does not have a rotational or linear movement, and the edge slope 62 and the extended edge 63 remain stationary.

The latch 150 has a latch tip 151. The locking finger 40 has a cutout 45 dimensioned to receive the latch tip 151 when the lock 10 is operated in the locked mode. As the cylinder 60 and the button 50 have no movement, the latch tip 151 of latch 150 remains engaged with the cutout 45 of locking finger 40 so that the locking finger 40 remains engaged with the hook 20.

The button 50 is also used to cause the spindle 70 to move downward in a spindle movement direction substantially parallel to the longitudinal axis 78 of spindle 70. The button 50 has a button slope 53, and the spindle 70 has a contact surface 71 positioned in relationship to the button slope 53. As described below in reference to the combination mechanism, the spindle 70 is movable in a spindle movement direction only when the user sets a correct combination on the combination mechanism. Otherwise, the spindle 70 has no motion relative to lock body 20 and the button 50 is prevented from being pushed inward. Only when the spindle 70 is movable, can the button 50 be pushed inward in a button movement direction from a first button position to a second button position. Through the contact between the button slope 53 and the contact surface 71 of spindle 70, the inward movement of the button 50 causes the contact surface 71 together with the spindle 70 to move from the first spindle position to the second spindle position in the spindle movement direction. The button movement direction is substantially perpendicular to the spindle movement direction.

When the button 50 is prevented from inward movement, the tip 151 of the latch 150 remains stationary. Furthermore, since the cylinder 60 has no rotational movement, the extended edge 63 of cylinder 60 does not exert a force upon the latch surface 153 of latch 150. As such, the latch tip 151 of latch 150 remains engaged with the cutout 45 of locking finger 40. The latch 150 is positioned in the latch path 26/36 of lock body 20/30. A latch spring 160 is placed in the spring-hole 154 of latch 150 to push the latch 150 toward the locking finger 40 to ensure the lock 10 remains in the locked position.

The Combination Mechanism

The combination mechanism comprises a plurality of clutches 80, including a rest-button clutch 100, movably disposed around the spindle 70, and a plurality of dials 90 engageable with the clutches 80/100 to control the rotation of the clutches. Each of the clutches 80/100 has one or more short fins 81/101 and one or more long fins 82/102 on the clutch's outer face, and an opening gap 83/103 made through the clutch's inner ring. The opening 84 of the inner ring on the clutches 80/100 allows the spindle 70 to pass through. Each of the dials 90 has a plurality of teeth 91. Each of the dials 90 is associated with a different one of the clutches 80/100. When lock 10 is in the locked mode, teeth 91 of dials 90 are arranged to engage with short fins 81/101 and long fins 82/102 of clutches 80/100. The rotation of each of dials 90 causes the rotation of the associated clutch 80/100 in the same manner. The spindle 70 has a plurality of protrusions 73, each of which is associated with one of the clutches 80/100. The spindle 70 also has a top edge 72 associated with the contact surface 71.

In the locked mode, the opening gap 83/103 of at least one of the clutches 80/100 is not aligned with the associated protrusion 73 of spindle 70. This misalignment prevents the spindle from moving downward. The top edge 72 of spindle 70 has a dual function. The first function is to prevent the spindle 70 from moving further upward when the lock 10 is in the locked mode as the top edge 72 is in contact with a spindle wall 29 of lock body 20. A spindle spring 120 is arranged to push a separation ring 130 together with the stack of clutches 80/100 away from the top edge 72 of spindle 70. As such, the relationship between the clutches 80/100 and the spindle 70 can be maintained. The second function of the top edge 72 is to prevent any rotational movement of the spindle 70 relative to lock body 20. Each of the clutches 80 has a set of faulty gates 85 on top and bottom of its inner ring. The reset-button clutch 100 has a set of faulty gates 106 on its upper side. When the lock 10 is in the locked mode, an unauthorized user may try to push the button 50 inward while rotating the dials 90 along with the clutches 80/100 in an attempt to align the opening gaps 83/103 with the protrusions 73 of spindle 70. Pushing the button 50 inward may force the spindle 70 slightly downward, causing the protrusions 73 of spindle 70 to become jammed into the faulty gates 85/106. As such, the dials 90 cannot be further rotated in order to align the opening gaps 83/103 of clutches 80/100 with the protrusions 73 of spindle 70.

In an embodiment of the present invention, both the combination mechanism and the overriding key mechanism are configured to control the movement of the latch 150 directly. When the latch tip 41 is disengaged from the cutout 45 of locking finger 40, the movement of the locking finger 40 to disengage from the hook 21 is caused by the spring action provided by the torque spring 110. However, the engagement of the locking finger 40 with the hook 21 from the disengaging position is manually carried out by the person who uses the combination mechanism or the key overriding mechanism.

Figure 12A:
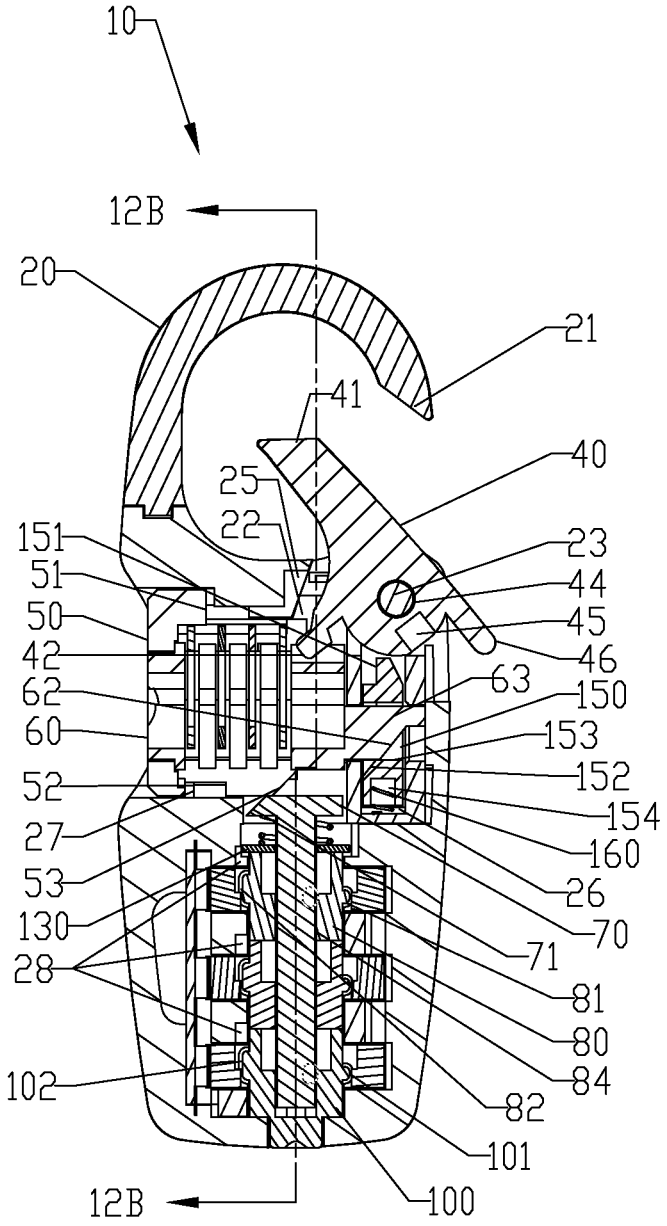
FIG. 12A is a cross-sectional view of a hook lock taken along line 12A-12A of FIG. 12B.
Figure 12B:
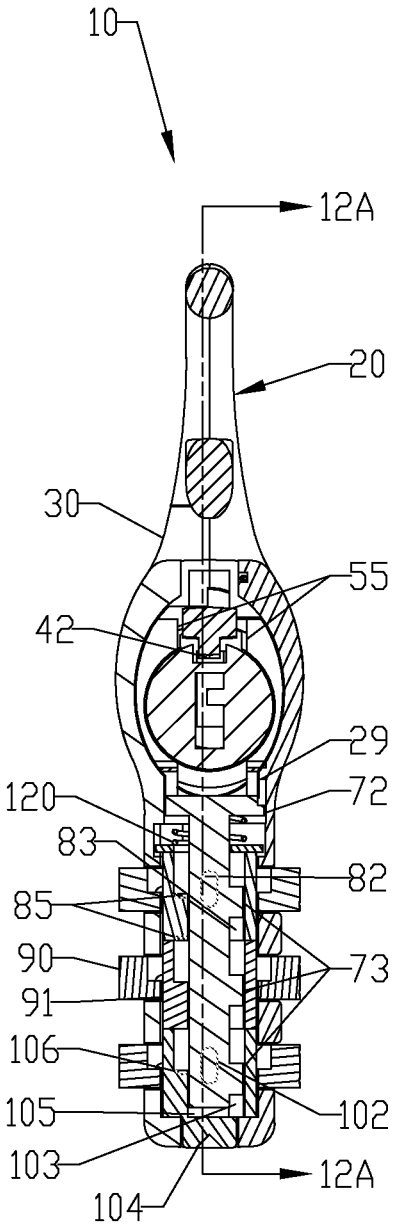
FIG. 12B is a cross-sectional view of a hook lock taken along line 12B-12B of FIG. 12A.

Unlock by Combination (FIG. 12A-12B)

When the lock 10 is in the locked mode, the teeth 91 of dials 90 are engaged with the short-fins 81/101 and the long fins 82/102 of clutches 80/100. As the dials 90 are rotated to form the correct combination (the lock-open code), the opening gaps 83/103 of the clutches 80/100 are aligned with the protrusions 73 of spindle 70. As such, the user can push the button 50 together with the cylinder 60 inward so that the contact between the button slope 53 and the contact surface 71 of the spindle 70 causes the spindle 70 to move downward, allowing the button 50 to move further inward together with the cylinder 60, causing the edge slope 62 to push the latch slope 152 together with the latch 150 downward. When the button 50 is moved from the first button position to the second position, the latch 150 is caused to move from the first latch position to the second latch position where the latch tip 151 is disengaged from the cutout 45 of locking finger 40. The locking finger 40, under the urging force of the torque spring 110, moves from the first locking position to the second locking position, causing the locking tip 41 of locking finger 40 to disengage from the hook 21 of lock body 20, thereby changing the lock 10 from the locked mode to the opened mode.

To change the lock 10 from the opened mode back to the locked mode, the user must move the locking finger 40 to engage it with the hook 21. Under the spring action of latch spring 160, the latch 150 is pushed upward toward the locking finger 40 to engage the latch tip 151 with the cutout 54 of locking finger 40. As the latch 150 moves upward, the edge slope 62, along with cylinder 60 and button 50, is pushed outward by the latch slope 152. As the button 50 is pushed from the second button position to the first button position, the button slope 53 is moving away from the contact surface 71 of spindle 70, allowing the spindle spring 120 to push the spindle 70 upward from the second spindle position to the first spindle position. The user can now rotate the dials 90 together with the clutches 80/100 so that one or more of the opening gaps 83/103 become misaligned with the protrusions 73 of spindle 70.

Figure 13A:
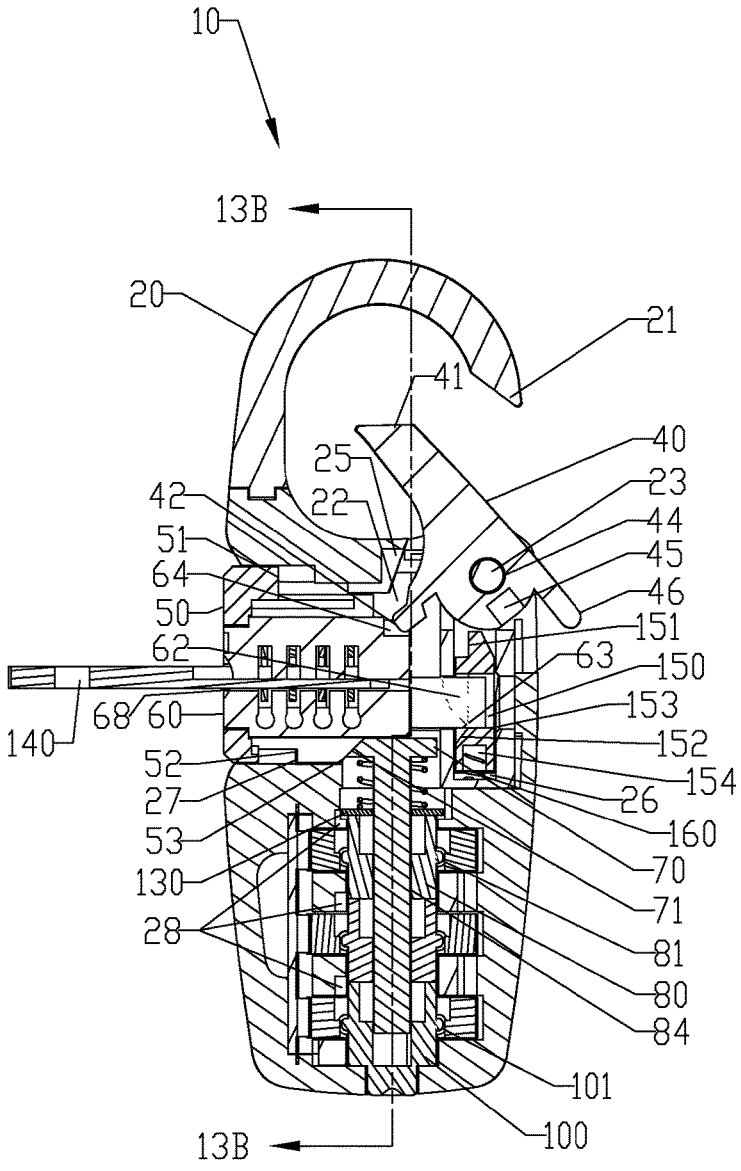
FIG. 13A is a cross-sectional view of a hook lock taken along line 13A-13A of FIG. 13B.
Figure 13B:
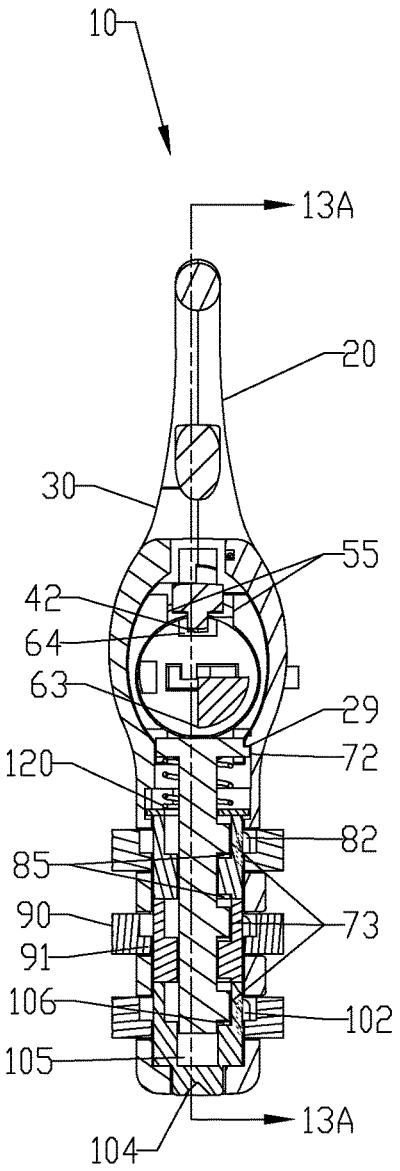
FIG. 13B is a cross-sectional view of a hook lock taken along line 13B-13B of FIG. 13A.

Unlock by Key (FIG. 13A-13B)

When a correct key (cut key) 140 is inserted into the key slot 68 of cylinder 60, the wafers in cylinder 60 are caused to move away from the wafer slots 55 of button 50, and the cylinder 60 can rotate. As the cylinder 60 rotates, the extended edge 63 of cylinder 60 also rotates and contacts the latch surface 153 of latch 150. As the extended edge 63 rotates further, the latch surface 153 together with the latch 150 is caused to travel further downward. When the latch 150 moves from the first latch position to the second latch position, the latch tip 151 becomes disengaged from the cutout 45 of locking finger 40. Under the spring action of the torque spring 110, the locking finger 40 moves away from the hook 21 to change the lock 10 to the opened mode. The key user must leave the key 140 in the cylinder 60 as the restriction wall 42 of the locking finger 40 is engaged with the key-captive slot 64 of cylinder 60. The engagement between the restriction wall 42 and the key-captive slot 64 prevents the cylinder 60 from rotation backward.

In the relocking process, the key-user must first push the locking-finger tail 46 back to the tail-receiving slot 20*a*/30*a* of lock body 20/30 to engage the locking finger 40 with the hook 21. By doing so, the restriction wall 42 becomes disengaged from the key-captive slot 64 of cylinder 60. Then the key-user can rotate the cylinder 60 and retrieve key 140 from cylinder 60. When the locking finger 40 is moved back to the locked position, the latch tip 151 and the cutout 45 of locking finger 40 are aligned. The latch 150 is pushed toward the locking finger 40 by the latch spring 160 to cause the latch tip 151 to engage with the cutout 45 of locking finger 40 to the locking position. The advantage of this arrangement is that the key user will lock the padlock before withdrawing the key from the cylinder.

Figure 14A:
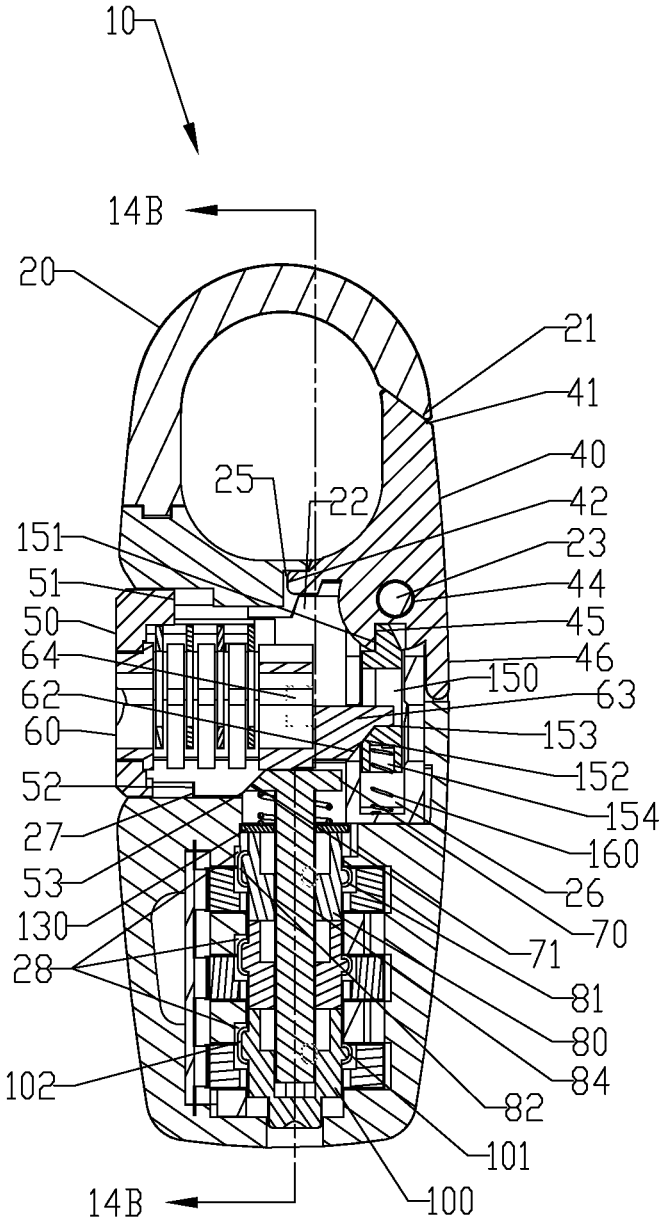
FIG. 14A is a cross-sectional view of a hook lock taken along line 14A-14A of FIG. 14B.
Figure 14B:
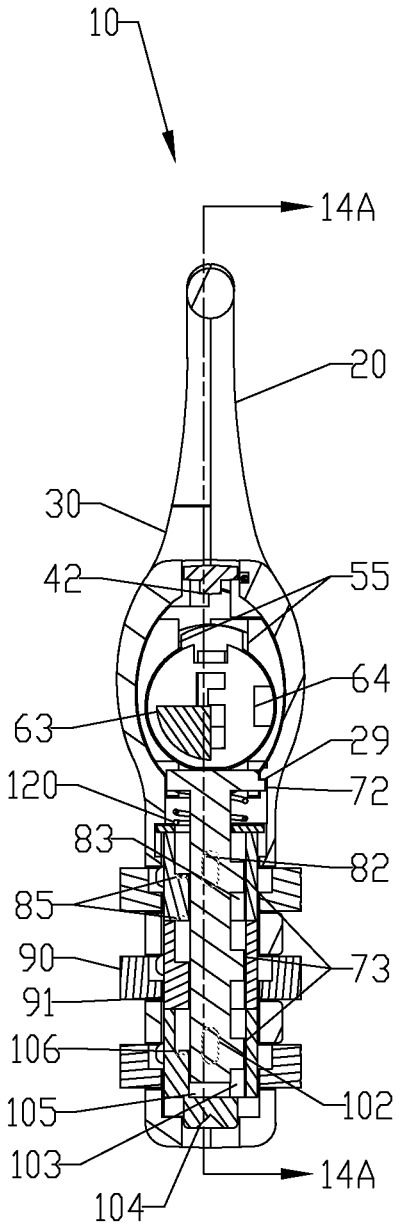
FIG. 14B is a cross-sectional view of a hook lock taken along line 14B-14B of FIG. 14A.

Reset Mode (FIG. 14A-14B)

When the lock 10 is opened using the lock open combination mode, the user can push the reset-button clutch 100 inward to cause short fins 81/101 and long fins 82/102 of clutches 80/100 to disengage from the teeth 91 of dials 90. The long fins 82/102 become engaged with the notches 28 of lock body 20 to prevent the clutches 80/100 from rotation during the entire reset process. Each of the protrusions 73 of the spindle 70 is also engaged with the opening gap 83/103 of the associated clutch 80/100. The user can rotate one or more dials 90 to set a new combination code. After setting the new code, the user can release the reset-button clutch 100 to allow the spindle spring 120 to push the separation ring 130 together with the stack of clutches 80/100 back to the original position. As such, the short fins 81/101 and long fins 82/102 of clutches 80/100 become engaged with the teeth 91 of dials 90. The separation ring 130 is used to separate the top clutch 80 from the spindle spring 120.

In summary, the present invention is directed to a hook lock 10 which is operable in a locked mode as shown in FIG. 1A, and in an opened mode as shown in FIG. 12A and FIG. 13A. As illustrated in FIG. 1A, the lock 10 has a lock body 20 having a first or upper body portion and a second or lower body portion; a hook 21 located in the first body portion; a locking finger 40 pivotally mounted in the first body portion in relationship to the hook 21. The lock 10 has a latch 150 engageable with the locking finger 40. The lock can be opened by a combination mechanism as shown in FIG. 12A or by an overriding mechanism as shown in FIG. 13A. When the lock 10 is in the locked mode, the locking finger 40 is in a first finger position to engage with the hook 21 and the latch 140 is in a first latch position (up) to engage with the locking finger 40. When the lock 10 is in the opened mode, the latch 150 is in a second latch position (down) and disengaged from the locking finger 40, and the locking finger 40 is in a second finger position and disengaged from the hook 21.

The combination mechanism has a plurality of clutches 80 forming a stack of clutches around a spindle 70, and a plurality of dials 90 engageable with the clutches 80. Each of the dials 90 has a plurality of indicia for forming a combination code. When the dials 90 are set to a correct combination, the spindle 70 can be pushed downward from a first spindle position (up) to a second or lower spindle position (down) in a spindle movement direction substantially parallel to the longitudinal axis 78 of spindle 70 by a button 50 which can be pushed inward from a first button position to a second button position. When the button 50 moves to the second button position, it also causes the latch 150 to move downward from the first latch position to the second latch position to open the lock.

The overriding key mechanism has a cylinder 60 having a key slot 68 on the first cylinder end (outside) to receive a key. When the key is inserted into the cylinder 60, the cylinder 60 can be rotated to cause the latch 150 to move from the first latch position to the second latch position to open the lock.

The latch 150 has a latch tip 151 and the locking finger 40 has a cutout 45 dimensioned to receive the latch tip 151 when the latch is in the first latch position (see FIG. 1A), and when the latch is caused to move downward from the first latch position to the second latch position (see FIGS. 12A and 13A), the latch tip 151 is disengaged from the cutout 45, allowing the locking finger 40 to move from the first finger position to the second finger position.

Figure 6A:
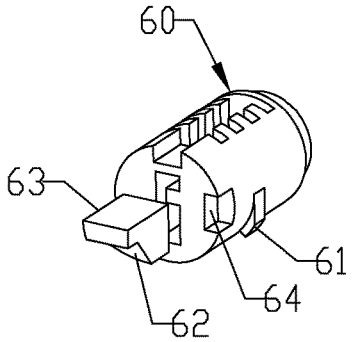
FIGS. 6A and 6B are perspective views of a cylinder forming part of the hook lock.
Figure 6B:
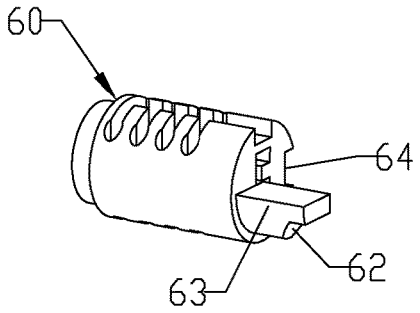

The spindle 70 has a first spindle end (upper) and a second spindle end (lower). The first spindle end has a contact surface 71. The button 50 has a button slope 53 positioned in relationship to the contact surface 71 of spindle 70. When the combination mechanism is set to a correct combination and the button 50 is pushed inward from the first button position to the second button position, the contact surface 71 is caused to move downward along with the spindle 70. The latch 150 has a latch slope 152. The button 50 is associated with an extended edge 63 having an edge slope 62 positioned in relationship to the latch slope 152. When the button 50 is pushed to the second button position, the edge slope 62 of the extended edge 63 causes the latch slope 152 together with the latch 150 to move downward in a direction substantially parallel to the spindle movement direction. As shown in FIG. 6A, the extended edge 63 is fixedly mounted on the second cylinder end.

In an embodiment of the present invention, the locking finger 40 also has a restriction wall 42 and the cylinder 60 also has a key-captive slot 64 dimensioned to receive the restriction wall 42 of locking finger 40. When the cylinder 60 is in the second cylinder position and the locking finger 40 is in the second finger position (see FIGS. 13A, 13B), the restriction wall 42 of locking finger 40 is engaged with the key-captive slot 64, preventing the cylinder 60 from rotating backward from the second cylinder position to the first cylinder position. When the cylinder 60 is in the second cylinder position, the key is prevented from moving out of the key slot, and the locking finger 40 can be caused to return to the first finger position so that the restriction wall 42 of the locking finger 40 is disengaged from the key-captive slot 64 of cylinder 60, allowing the cylinder 60 to return to the first cylinder position and the key to be retrieved from the key slot.

Figure 7:
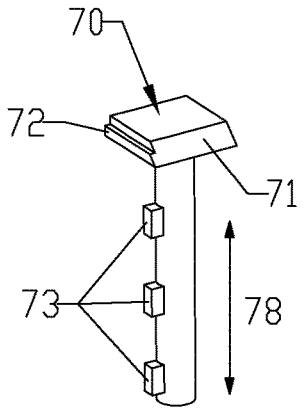
FIG. 7 is a perspective view of a spindle forming part of the hook lock.
Figure 8A:
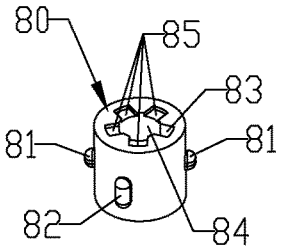
FIGS. 8A and 8B are perspective views of a clutch forming part of the hook lock.
Figure 8B:
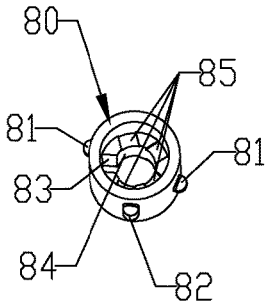
Figure 9:
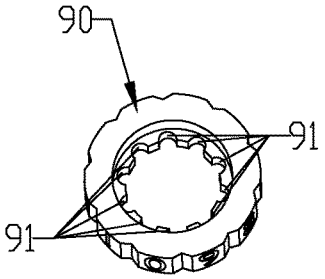
FIG. 9 is a perspective view of a dial forming part of the hook lock.
Figure 10A:
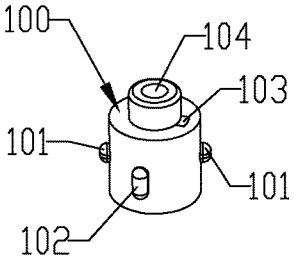
FIGS. 10A and 10B are perspective views of a reset-button-with-clutch forming part of the hook lock.
Figure 10B:
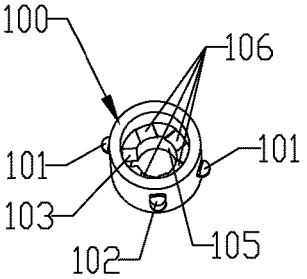
Figure 11:
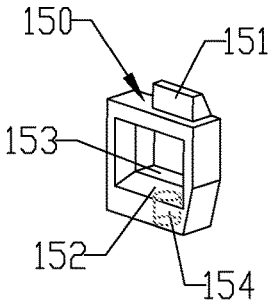
FIG. 11 is a perspective view of a latch forming part of the hook lock.

In an embodiment of the present invention, the lock body 20 has a torque spring 110 positioned in relationship to the locking finger 40. When the latch tip 151 is disengaged from the cutout 45 of locking finger 40, the torque spring is arranged to urge the locking finger 40 to move from the first finger position to the second finger position. As shown in FIG. 7, the spindle 70 has a plurality of protrusions 73. As shown in FIG. 8B, each of the clutches 80 has an opening gap 83 associated with the protrusion of a different one of the spindle. When the dials are set to the correct combination, the opening-gap 83 of each of the clutches 80 is aligned to the associated protrusion 73 of spindle 70, allowing the spindle to move downward from the first spindle position to the second spindle position.

Figure 1B:
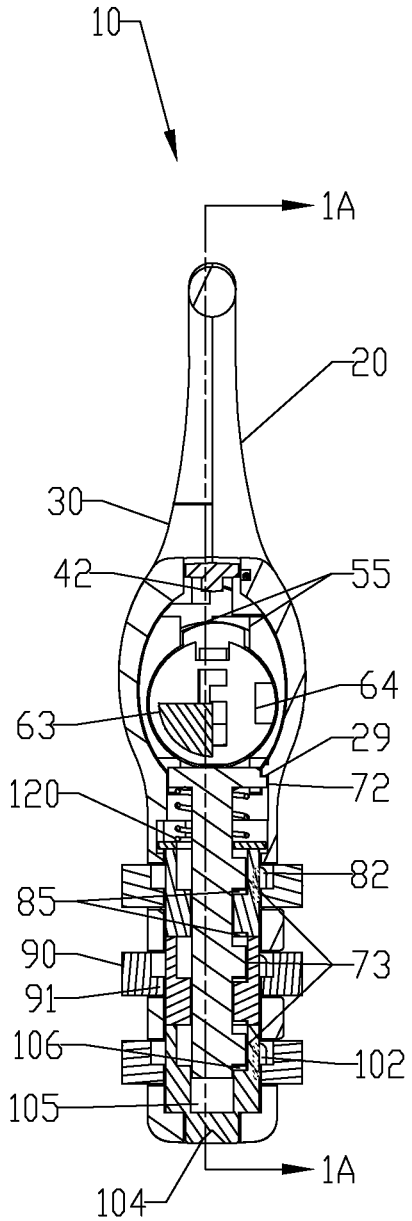
FIG. 1B is a cross-sectional view of the hook lock taken along line 1B-1B of FIG. 1A.

As shown in FIG. 1B, the lock body also has a spring 120 positioned in relationship to the spindle 170. When the button 50 is located in the first button position, the spring 120 is arranged to urge the spindle 70 to remain in the first spindle position (up).

As shown in FIG. 7, the spindle 70 also has a top edge 72 associated with the contact surface 71. As shown in FIG. 1B, the spring 120 is placed between the top edge 72 of spindle 70 and the stack of clutches 80.

As shown in FIG. 1A, the lock body also has a spring 160 positioned in relationship to the latch 150, and the spring 160 is arranged to urge the latch 150 to move toward the locking finger 40.

In an embodiment of the present invention, each of the clutches 80 is associated with a different one of the dials 90. Each of the clutches 80 has a plurality of clutch fins 81/82, and each of the dials 90 has a plurality of teeth 91 arranged to engage with the clutch fins 81/82 for rotation together relative to the spindle 70. When the spindle 70 is in the second spindle position (down), the clutches 80 can be caused to move upward relative to the spindle 70 and the dials 90 to a reset position. At the reset position, the clutch fins 81/82 become disengaged from the teeth 91 of dials 90 while the protrusions 73 of spindle 70 are engaged with the opening gaps 83 of the clutches, allowing the dials 90 to rotate relative to the clutches 90 to set a new combination code.

Figure 2:
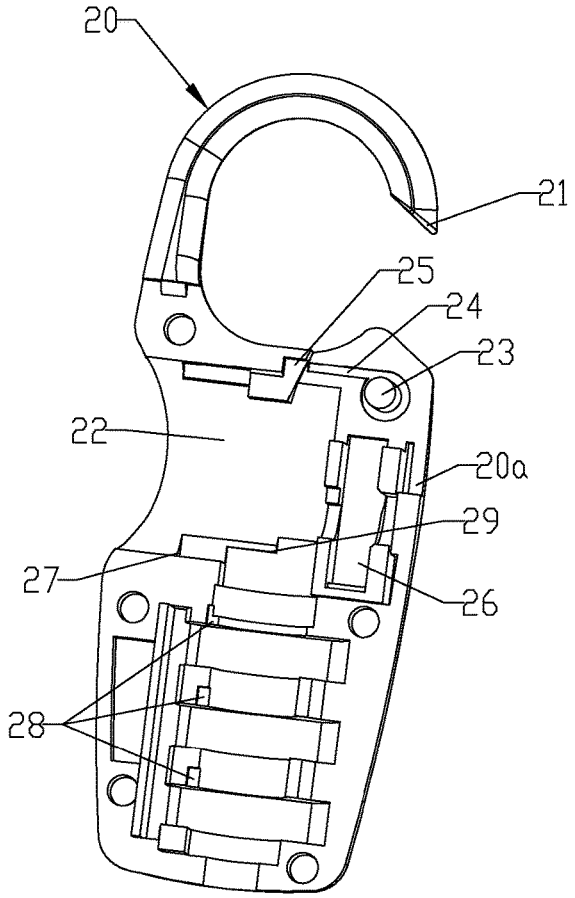
FIG. 2 is a perspective view of a lock body half forming part of the hook lock.
Figure 3:
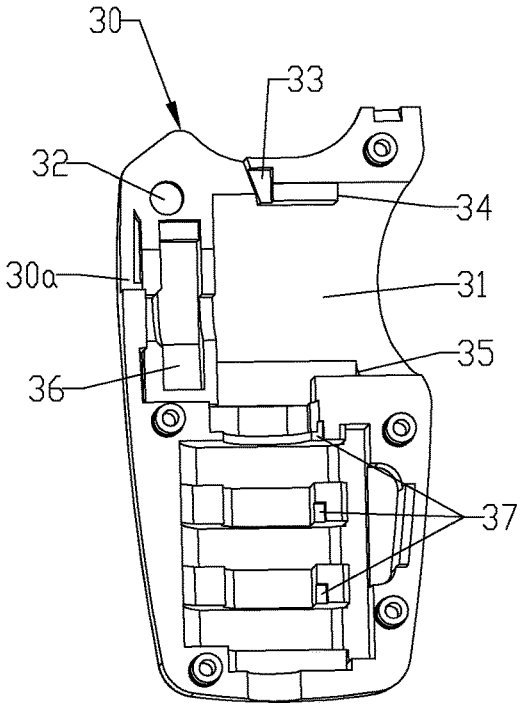
FIG. 3 is a perspective view of another lock body half forming part of the hook lock.
Figure 4A:
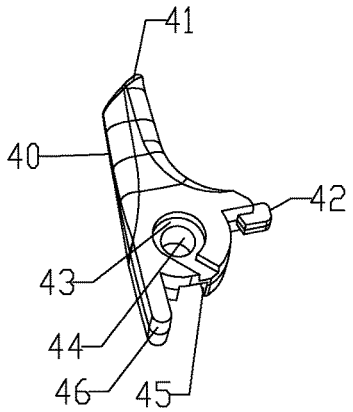
FIGS. 4A and 4B are opposite perspective views of a locking finger.
Figure 4B:
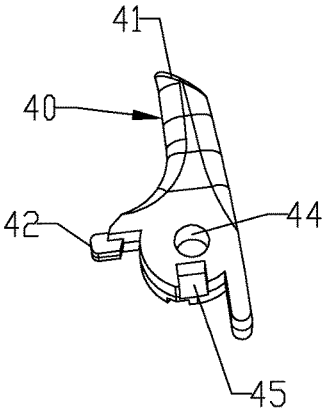
Figure 5:
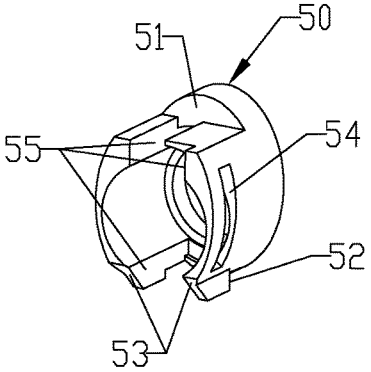
FIG. 5 is a perspective view of a button forming part of the hook lock.

As shown in FIG. 2, the lock body 20 has a plurality of notches 28 arranged to receive the long fins 82 of clutches 80 when the clutches 80 are in the reset position, preventing the clutches 80 from rotation relative to the spindle 70.

Thus, although the invention has been described and illustrated with respect to exemplary embodiments thereof, the foregoing and various other additions and omissions may be made therein and thereto without departing from the scope of the present invention.

What is claimed is:

1. A lock operable in a locked mode and in an opened mode, said lock comprising:

a lock body having a first body portion and a second body portion;

a hook having a tip at one end, the hook located in the lock body;

a locking finger having a tip, the locking finger pivotally mounted in the lock body so that when the lock is in the locked mode, the locking finger is in a first finger position wherein the tip of the locking finger contacts the tip of the hook, and when the locking finger is in a second finger position, the lock is in the opened mode and the locking tip of the locking finger is not in contact with the tip of the hook so that the locking finger can be pivoted away from the hook;

a latch operable in a first latch position and a second latch position, wherein when the latch is in the first latch position, the locking finger is prevented from moving from the first finger position to the second finger position, and when the latch is in the second latch position, the locking finger is allowed to move from the first finger position to the second finger position;

a button located in the lock body, the button operable in a first button position and a second button position, wherein when the button is caused to move from the first button position to the second button position, the latch is caused to move from the first latch position to the second latch position, wherein the latch comprises a latch tip and the locking finger comprises a cutout dimensioned to receive the latch tip when the latch is in the first latch position, and when the latch is caused to move from the first latch position to the second latch position, the latch tip is disengaged from the cutout, allowing the locking finger to move from the first finger position to the second finger position, and a combination mechanism located in the lock body, the combination mechanism comprising a spindle having a longitudinal axis, the spindle comprising a first spindle end and a second spindle end, the first spindle end having a contact surface, wherein when the combination mechanism is set to a correct combination, the spindle can be moved from a first spindle position to a second spindle position in a spindle movement direction substantially parallel to the longitudinal axis, and when the combination mechanism is set to the correct combination and the button is moved from the first button position to the second button position, the contact surface is caused to move along with the spindle from the first spindle position to the second spindle position in the spindle movement direction, and the latch is caused to move in a latch movement direction from the first latch position to the second latch position, wherein the latch movement direction is substantially parallel to the spindle movement direction, thereby putting the lock in the opened mode so that the locking finger moves to the second finger position where the locking finger can be pivoted away from the hook.

2. The lock according to claim 1, wherein the combination mechanism further comprises:

a plurality of clutches disposed around the spindle, and a plurality of dials engageable with the clutches to control movement of the spindle, the dials having a plurality of indicia to form the correct combination, and wherein the button comprises a button slope positioned in relationship to the contact surface of the spindle and wherein when the button is moved from the first button position to the second button position, the button slope of the button causes the contact surface to move along with the spindle from the first spindle position to the second spindle position in the spindle movement direction.

3. The lock according to claim 2, wherein the latch further comprises a latch slope and the button is associated with an extended edge having an edge slope positioned in relationship to the latch slope, and wherein when the button is moved from the first button position to the second button position, the edge slope of the extended edge is arranged to cause the latch slope together with the latch to move in the latch movement direction.

4. The lock according to claim 3 further comprising an overriding key mechanism comprising a cylinder positioned in relationship to the button, the cylinder comprising a first cylinder end and a second cylinder end, wherein the extended edge of the button is fixedly mounted on the second cylinder end, and wherein when the button is moved from the first button position to the second button position, the edge slope of the extended edge and the cylinder is caused to move together with the button.

5. The lock according to claim 4, wherein the first cylinder end comprises a key slot dimensioned to receive a key and wherein when the button is in the first button position and the key is inserted into the key slot of the cylinder, the cylinder can be caused to rotate from a first cylinder position to a second cylinder position together with the extended edge in a rotation direction relative to the button, the edge slope is arranged to move the latch slope together with the latch in the latch movement direction from the first latch position to the second latch position.

6. The lock according to claim 5, wherein the locking finger further comprises a restriction wall and the cylinder further comprises a key-captive slot dimensioned to receive the restriction wall of the locking finger, and wherein when the cylinder is in the second cylinder position and the locking finger is in the second finger position, the restriction wall of the locking finger is engaged with the key-captive slot, preventing the cylinder from moving from the second cylinder position to the first cylinder position, and when the cylinder is in the second cylinder position, the key is prevented from moving out of the key slot.

7. The locking according to claim 6, wherein when the cylinder is in the second cylinder position, the locking finger can be caused to return to the first finger position and the restriction wall of the locking finger is disengaged from the key-captive slot of the cylinder, allowing the cylinder to return to the first cylinder position and the key to be retrieved from the key slot.

8. The lock according to claim 2, wherein the spindle further comprises a plurality of protrusions and each of the clutches comprises an opening gap associated with the protrusion of a different one of the spindle, and wherein when the dials are set at the correct combination, the opening-gap of each of the clutches is aligned to the associated protrusion of the spindle, allowing the spindle to move from the first spindle position to the second spindle position.

9. The lock according to claim 2, wherein the lock body further comprises a spring positioned in relationship to the spindle, and when the button is located in the first button position, the spring is arranged to urge the spindle to remain in the first spindle position, and wherein the spindle also has a top edge associated with the contact surface, and the plurality of clutches form a stack of clutches disposed around the spindle, wherein the spring is placed between the top edge of the spindle and the stack of clutches.

10. The lock according to claim 1, wherein the lock body further comprises:

a coil spring positioned in relationship to the latch, the coil spring arranged to urge the latch to move toward the locking finger, and a torque spring positioned in relationship to the locking finger, and when the latch tip is disengaged from the cutout of the locking finger, the torque spring is arranged to urge the locking finger to move from the first finger position to the second finger position.

11. The lock according to claim 2, wherein each of the clutches is associated with a different one of the dials, each of the clutches comprising a plurality of clutch fins, each of the dials comprising a plurality of teeth arranged to engage with the clutch fins for rotation together relative to the spindle, and wherein when the spindle is in the second spindle position, the clutches can be caused to move relative to the spindle and the dials to a reset position so that the clutch fins become disengaged from the teeth while the protrusions of the spindle are engaged with the opening gaps of the clutches, allowing the dials to rotate relative to the clutches, and wherein the clutch fins comprise one or more longer fins, and the lock body further comprises a plurality of notches arranged to receive the longer fins when the clutches are in the reset position, preventing the clutches from rotation relative to the spindle.

12. The lock according to claim 3, further comprising a key mechanism comprising a cylinder, the cylinder having a first cylinder end and a second cylinder end, and an extended edge fixedly mounted on the second cylinder end, wherein the first cylinder end comprises a key slot dimensioned to receive a key, and when the key is inserted into the key slot of the cylinder, the cylinder can be caused to rotate from a first cylinder position to a second cylinder position together with the extended edge of the cylinder in a rotation direction relative to the button, and the edge slope of the button is arranged to move the latch slope together with the latch from the first latch position to the second latch position, wherein the locking finger further comprises a restriction wall and the cylinder further comprises a key-captive slot dimensioned to receive the restriction wall of the locking finger, and wherein when the cylinder is in the second cylinder position and the locking finger is in the second finger position, the restriction wall of the locking finger is engaged with the key-captive slot, preventing the cylinder from moving from the second cylinder position to the first cylinder position, and when the cylinder is in the second cylinder position, the key is prevented from moving out of the key slot.

13. A lock operable in a locked mode and in an opened mode, said lock comprising:

a lock body;

a hook fixedly disposed on the lock body;

a locking finger pivotally mounted on the lock body in relationship to the hook, the locking finger operable in a first finger position when the lock is in the locked mode, and in a second finger position when the lock is in the opened mode;

a latch operable in a first latch position and a second latch position, wherein when the latch is in the first latch position, the locking finger is prevented from moving from the first finger position to the second finger position, and when the latch is in the second latch position, the locking finger is allowed to move from the first finger position to the second finger position, wherein the latch comprises a latch tip and the locking finger comprises a cutout dimensioned to receive the latch tip when the latch is in the first latch position, and when the latch is caused to move from the first latch position to the second latch position, the latch tip is disengaged from the cutout, allowing the locking finger to move from the first finger position to the second finger position thereby allowing the locking finger to pivot away from the hook;

a key mechanism comprising a cylinder, the cylinder having a first cylinder end and a second cylinder end, and an extended edge fixedly mounted on the second cylinder end, wherein the first cylinder end comprises a key slot dimensioned to receive a key and when the key is inserted into the key slot of the cylinder, the cylinder can be caused to rotate from a first cylinder position to a second cylinder position together with the extended edge in a rotation direction relative to the lock body, so that the latch can move from the first latch position to the second latch position, wherein the locking finger further comprises a restriction wall and the cylinder further comprises a key-captive slot dimensioned to receive the restriction wall of the locking finger, and wherein when the cylinder is in the second cylinder position and the locking finger is in the second finger position, the restriction wall of the locking finger is engaged with the key-captive slot, preventing the cylinder from moving from the second cylinder position to the first cylinder position, and when the cylinder is in the second cylinder position, the key is prevented from moving out of the key slot.

* * * * *